US008360939B2

(12) United States Patent
Huang

(10) Patent No.: US 8,360,939 B2
(45) Date of Patent: Jan. 29, 2013

(54) EXERCISER THAT PROVIDES SPEED-CONTROLLABLE POWER SUBJECT TO OPERATION

(75) Inventor: Jason Huang, Changhua County (TW)

(73) Assignee: B. Green Technology Co., Ltd., Changhua County (TW)

( * ) Notice: Subject to any disclaimer, the term of this patent is extended or adjusted under 35 U.S.C. 154(b) by 344 days.

(21) Appl. No.: 12/873,559

(22) Filed: Sep. 1, 2010

(65) Prior Publication Data

US 2011/0201482 A1 Aug. 18, 2011

(30) Foreign Application Priority Data

Feb. 12, 2010 (TW) ..... 99104774 A

(51) Int. Cl.
*A63B 21/008* (2006.01)

(52) U.S. Cl. ..... 482/112; 482/1; 482/8; 482/9

(58) Field of Classification Search ..... 482/1–9, 482/112, 113, 900–902; 434/247
See application file for complete search history.

(56) References Cited

U.S. PATENT DOCUMENTS 5,755,645 A * 5/1998 Miller et al. ..... 482/115
7,094,184 B1 * 8/2006 Chen et al. ..... 482/93
8,162,802 B2 * 4/2012 Berg ..... 482/2

* cited by examiner

*Primary Examiner* — Glenn Richman
(74) *Attorney, Agent, or Firm* — Muncy, Geissler, Olds & Lowe, PLLC

(57) ABSTRACT

An exerciser includes a mechanical unit having a first mechanical member and a second mechanical member operable by one part of the body of a human being, a speed-controllable power drive having a first connection end and a second connection end respectively connected to the first mechanical member and the second mechanical member and being drivable by a power source to move the second mechanical member in making a first action and a second action relative to the first mechanical member, and an induction control unit having a first sensor set installed in the mechanical unit and a second sensor set installed in the speed-controllable power drive for controlling the operation of the speed-controllable power drive. The first sensor set is movable with the mechanical unit relative to the second sensor set between a first position where the induction control unit drives the speed-controllable power drive to move the second mechanical member in making the first action and a second position where the induction control unit drives the speed-controllable power drive to move the second mechanical member in making the second action.

10 Claims, 5 Drawing Sheets

EXERCISER THAT PROVIDES SPEED-CONTROLLABLE POWER SUBJECT TO OPERATION

BACKGROUND OF THE INVENTION

1. Field of the Invention

The present invention relates to physical exercising machines and more particularly, to an exerciser that provides speed-controllable power subject to operation.

2. Description of the Related Art

Conventional physical exercising machines commonly use weights, brake means, spring means of damper means to give a load to the users operating the machines. However, this kind of load is not practical for speed-controllable training. A speed-controllable training must be performed by means of special equipment.

Commercial speed-controllable exercise equipments are commonly expensive, and designed for professional analysis and special training. Although speed-controllable training acts an important role in weight training and rehabilitation exercises, it still cannot be popularized due to the expensive cost of hardware equipment. Therefore, it is desirable to provide simple and inexpensive exercise equipments for speed-controllable training, i.e., improvement of conventional speed-controllable exercise equipments is necessary.

SUMMARY OF THE INVENTION

The present invention has been accomplished under the circumstances in view. It is the main object of the present invention to provide an exerciser, which uses an induction control unit to match with a speed-controllable power drive to provide a force corresponding to or against the operation direction of the user for concentric training (where the applied force is against the direction of the muscle contraction) or eccentric training (where the applied force and the muscle contraction are in the same direction).

To achieve this and other objects of the present invention, an exerciser comprises a mechanical unit, a speed-controllable power drive and an induction control unit. The mechanical unit comprises a first mechanical member and a second mechanical member operable by one part of the body of a human being. The speed-controllable power drive comprises a first connection end and a second connection end respectively connected to the first mechanical member and second mechanical member of the mechanical unit. The speed-controllable power drive is drivable by a power source to move the second mechanical member in making a first action and a second action relative to the first mechanical member. The induction control unit comprises a first sensor set installed in the mechanical unit and a second sensor set installed in the speed-controllable power drive for controlling the operation of the speed-controllable power drive. The first sensor set is movable with the mechanical unit relative to the second sensor set between a first position where the induction control unit drives the speed-controllable power drive to move the second mechanical member in making the first action and a second position where the induction control unit drives the speed-controllable power drive to move the second mechanical member in making the second action.

DETAILED DESCRIPTION OF THE INVENTION

Figure 1:
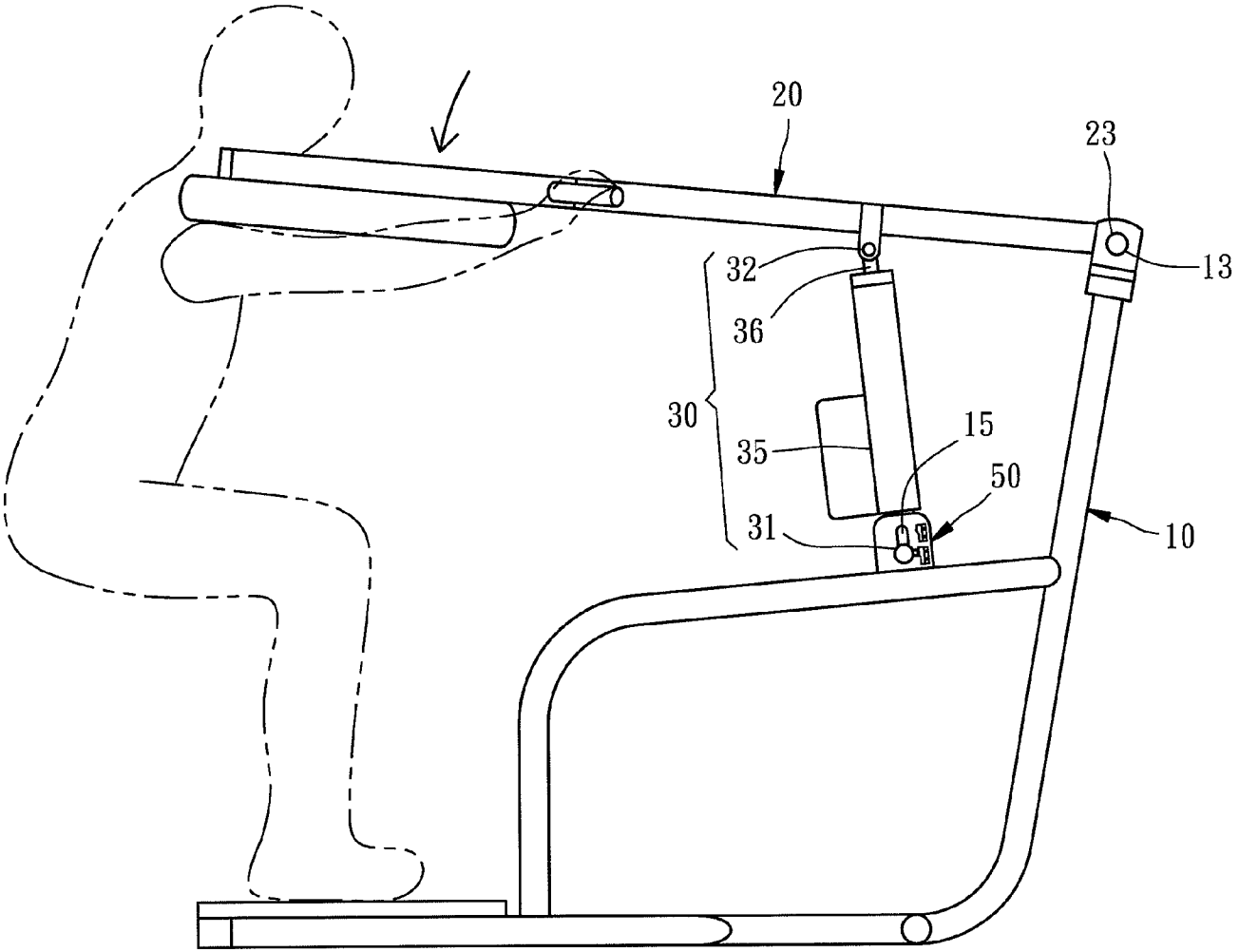
FIG. 1 is a schematic side view of an exerciser in accordance with a first embodiment of the present invention, illustrating an operation in one direction.
Figure 2:
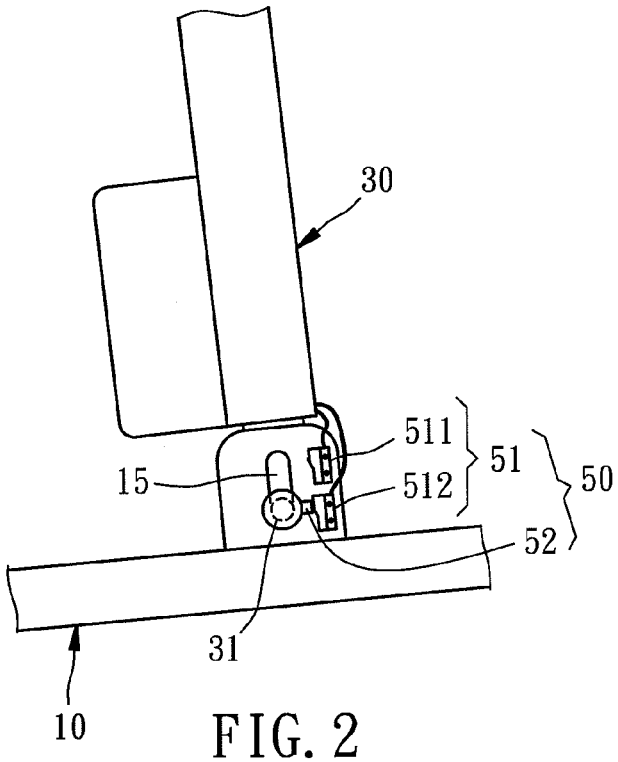
FIG. 2 is an enlarged view of a part of FIG. 1.
Figure 3:
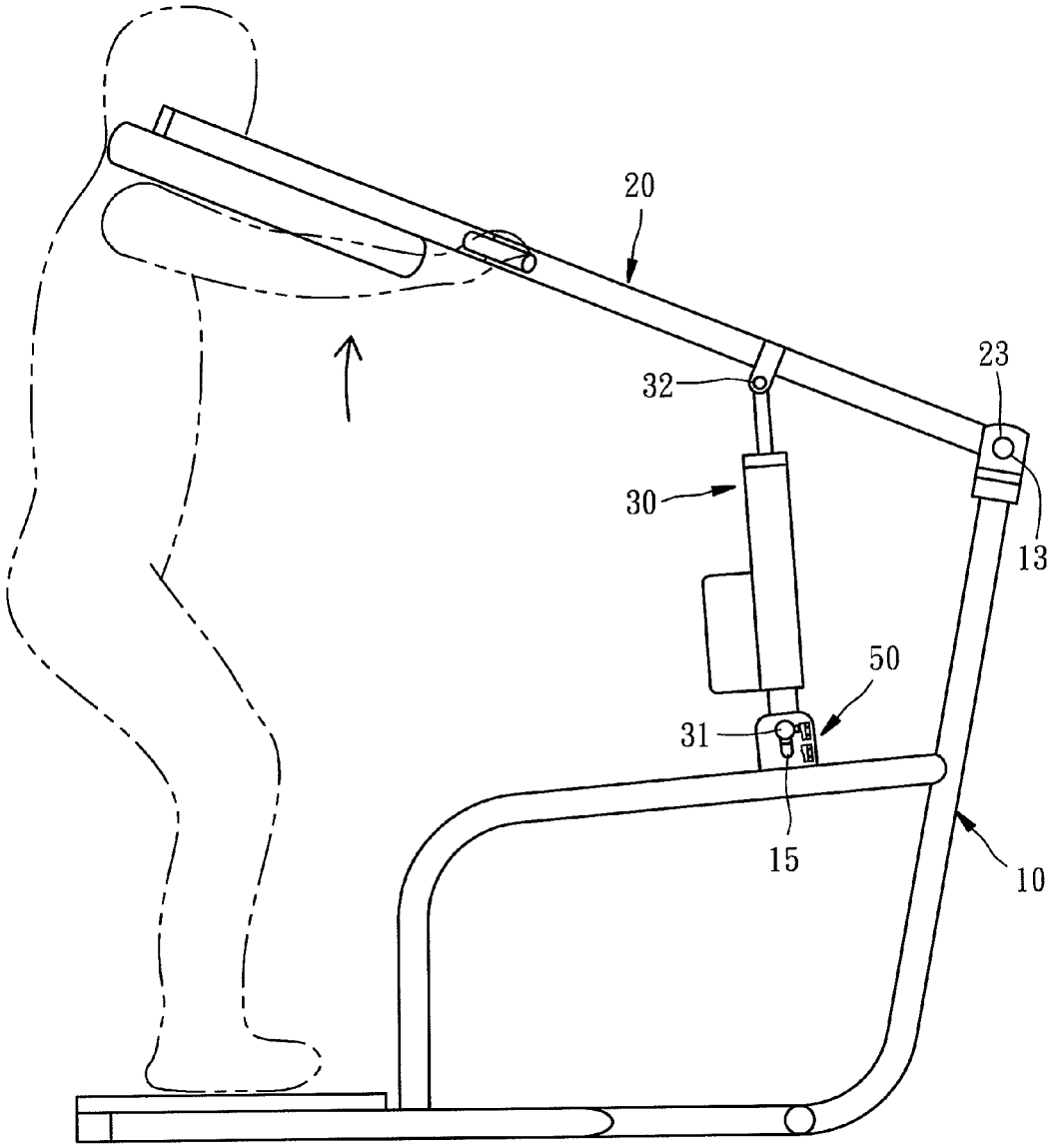
FIG. 3 corresponds to FIG. 1, showing the exerciser operated in the other direction.

Referring to FIGS. 1~3, an exerciser that provides speed-controllable power subject to operation in accordance with a first embodiment of the present invention is shown comprising a mechanical unit, a speed-controllable power drive 30 and an induction control unit 50.

The aforesaid mechanical unit comprises a first mechanical member 10 and a second mechanical member 20. The first mechanical member 10 has a connection portion 13 and an elongated slot 15. The second mechanical member 20 has a connection portion 23 pivotally connected to the connection portion 13 of the first mechanical member 10 and movable (biasable) relative to the first mechanical member 10 by a part of the body of a user.

The speed-controllable power drive 30 comprises a first connection end 31 and a second connection end 32 respectively connected to the first mechanical member 10 and the second mechanical member 20. The speed-controllable power drive 30 can be driven by a power source to provide a force to the second mechanical member 20, causing the second mechanical member 20 to make a first action and a second action relative to the first mechanical member 10. According to this first embodiment of the present invention, the speed-controllable power drive 30 is a motor and screw set, comprising a body 35 and an actuating member 36 movable relative to the body 35. Further, the power source for driving the speed-controllable power drive 30 according to this first embodiment of the present invention is electric power.

Further, the first connection end 31 of the speed-controllable power drive 30 is coupled to and movable along the elongated slot 15 of the first mechanical member 10.

The induction control unit 50 comprises a first sensor set 51 installed in the mechanical unit, and a second sensor set 52 installed in the speed-controllable power drive 30. When the first sensor set 51 is moved to a first position relative to the second sensor set 52, it drives the speed-controllable power drive 30 to move the second mechanical member 20, causing the second mechanical member 20 to make a first action relative to the first mechanical member 10. When the first sensor set 51 is moved to a second position relative to the second sensor set 52, it drives the speed-controllable power drive 30 to move the second mechanical member 20, causing the second mechanical member 20 to make a second action relative to the first mechanical member 10. Further, the first sensor set 51 comprises a first switch 511 and a second switch 512. The second sensor set 52 of the induction control unit 50 is a switch control device that can be any of a variety of control switches or induction switches.

The operation of the present invention is outlined hereinafter.

Figure 4:
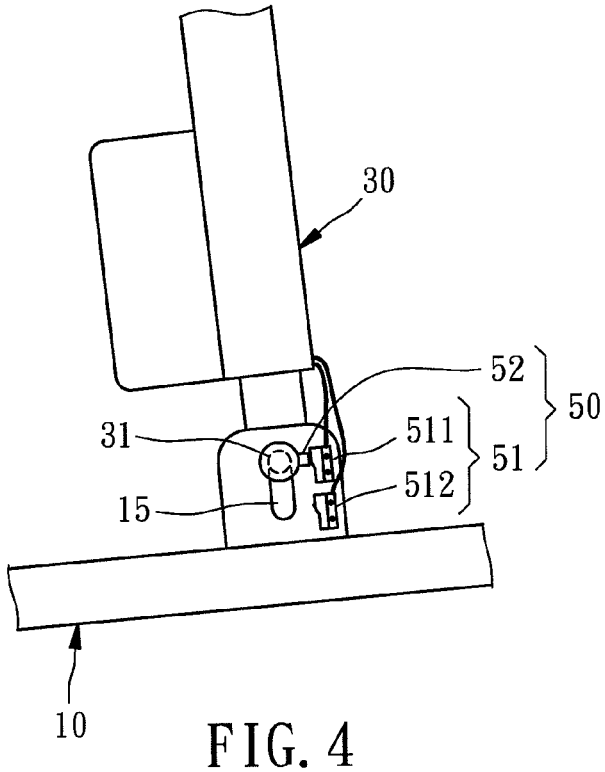
FIG. 4 is an enlarged view of a part of FIG. 3.

As shown in FIGS. 3 and 4, when the user lifts the second mechanical member 20, the second mechanical member 20 is moved relative to the first mechanical member 10 subject to the connection arrangement between the connection portion 13 of the first mechanical member 10 and the connection portion 23 of the second mechanical member 20. At this time, the second mechanical member 20 moves the second connection end 32 of the speed-controllable power drive 30, causing the first connection end 31 of the speed-controllable power drive 30 to be moved along the elongated slot 15 of the first mechanical member 10. At the same time, the switch control device of the second sensor set 52 of the induction control unit 50 induces the first switch 511 of the first sensor set 51, causing the first switch 511 to switch on the speed-controllable power drive 30, and therefore the speed-controllable power drive 30 is caused to extend out (or to retract), driving the second mechanical member 20 to make a first action relative to the first mechanical member 10.

On the contrary, when the user moves the second mechanical member 20 in the reversed direction, the switch control device of the second sensor set 52 of the induction control unit 50 induces the second switch 512 of the first sensor set 51, causing the second switch 512 to switch on the speed-controllable power drive 30, and therefore the speed-controllable power drive 30 is caused to retract (or to extend out), driving the second mechanical member 20 to make a second action relative to the first mechanical member 10.

Figure 5:
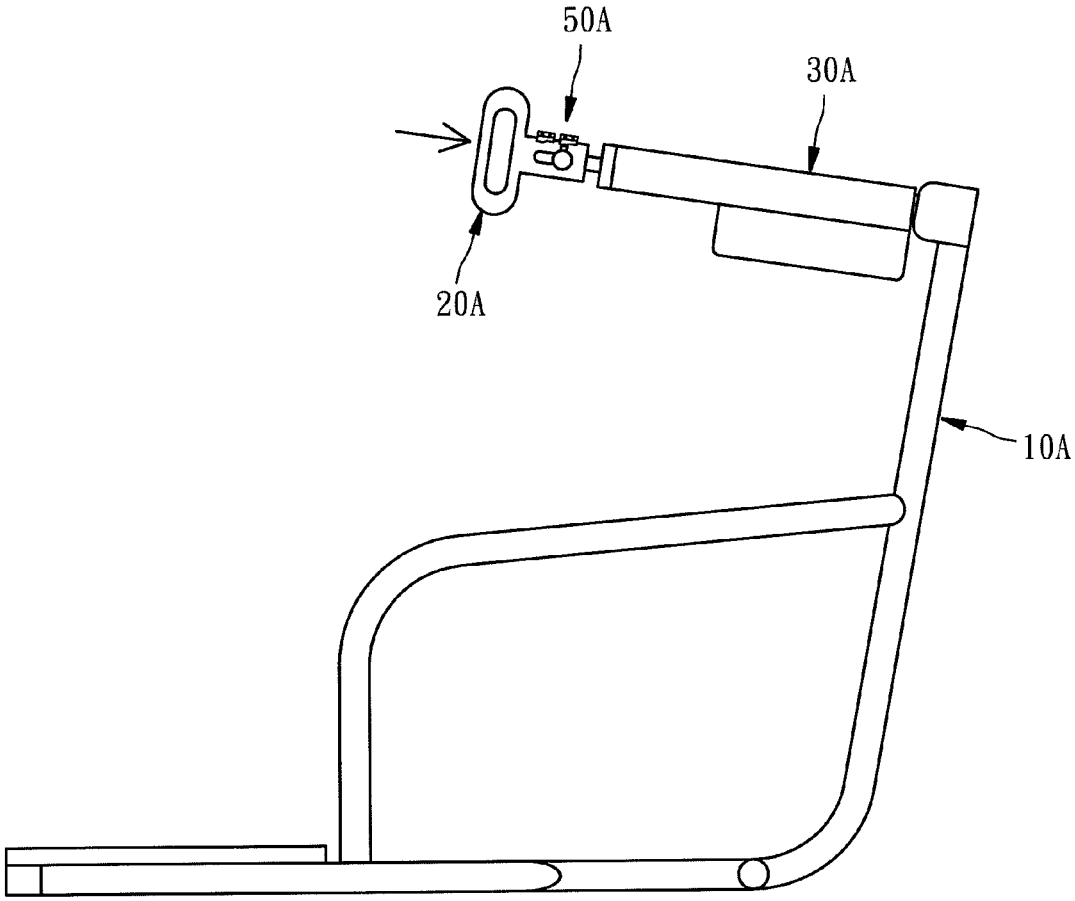
FIG. 5 is a schematic side view of an exerciser in accordance with a second embodiment of the present invention, illustrating an operation in one direction.
Figure 6:
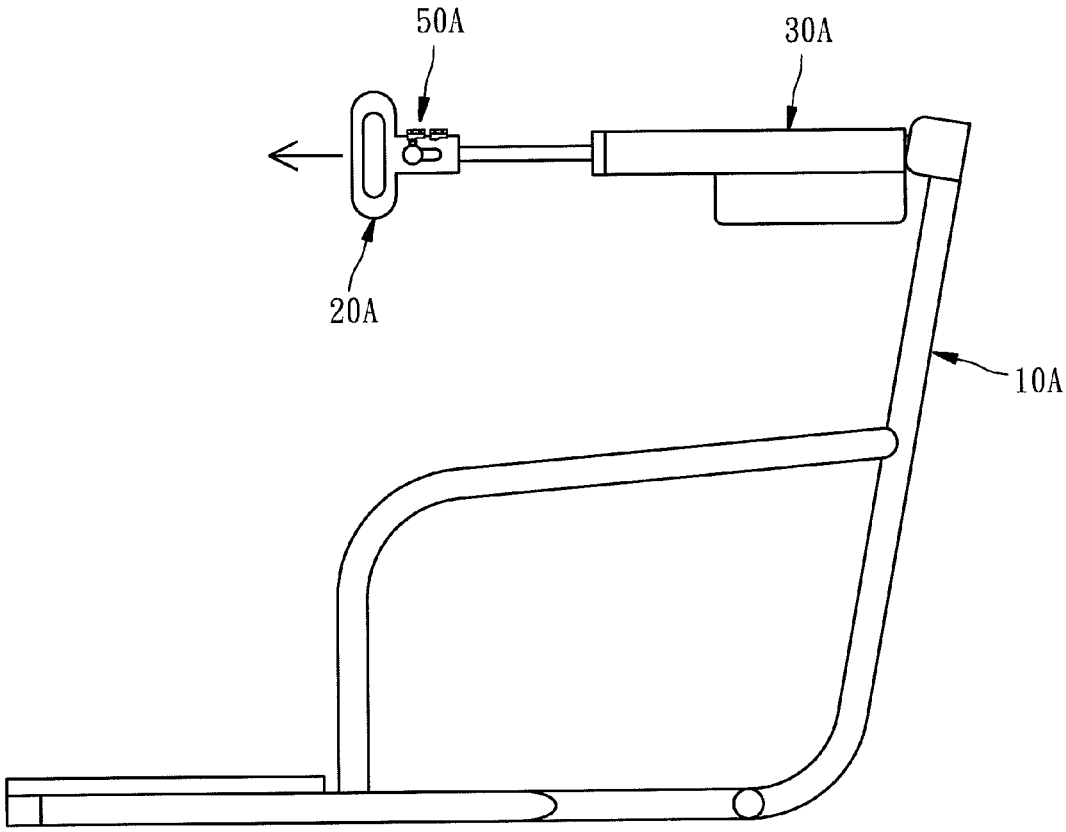
FIG. 6 corresponds to FIG. 5, showing the exerciser operated in the other direction.

FIGS. 5 and 6 illustrate an exerciser in accordance with a second embodiment of the present invention. This second embodiment is substantially similar to the aforesaid first embodiment with the exception of the following features:

At first, the second mechanical member 20A is not connected to the first mechanical member 10A; the speed-controllable power drive 30A has its first and second connection ends respectively connected to the first mechanical member 10A and the second mechanical member 20A.

Further, the first switch 511 and second switch 512 of the first sensor set 51 of the induction control unit 50A are installed in the second mechanical member 20A, the second mechanical member 20A has an elongated slot, the elongated slot of the second mechanical member 20A is coupled to and movable along second connection end of the speed-controllable power drive 30A.

Further, the elongated slot can be formed in the second connection end of the speed-controllable power drive, and the first switch and second switch of the first sensor set of the induction control unit can be installed in the second connection end of the speed-controllable power drive.

Further, the first connection end of second connection end of the speed-controllable power drive can be pivotally connected to the mechanical unit and biasable relative to the mechanical unit. Alternatively, the first connection end of second connection end of the speed-controllable power drive can be slidably connected to the mechanical unit, and movable linearly relative to the mechanical unit.

Further, the invention can also be made in many other alternate forms, having the features as follows:

At first, the first mechanical member and the second mechanical member can be moved relative to each other in parallel displacement, swinging, rotation, or their combination.

Further, except the aforesaid motor and screw set, the speed-controllable power drive can be a hydraulic cylinder, a pneumatic cylinder, or a worm and worm gear set.

Further, except electric power, the power source can be a pneumatic power source or hydraulic power source.

Further, the operation speed of the speed-controllable power drive can be a constant speed, acceleration or deceleration. Further, the acceleration or deceleration can be constant acceleration or constant deceleration.

Further, the action of the speed-controllable power drive can be a linear action, swinging action or rotary action.

In general, the speed-controllable power drive can work in a speed adjustable manner, or at a constant speed. Further, the speed adjustment can be done either manually or automatically, in a single step or multi-step manner. Further, the speed adjustment can be programmable.

Further, the invention is not limited to the aforesaid modifications.

For example, the second mechanical member can be kept apart from the first mechanical member, and the speed-controllable power drive can be directly coupled to the first mechanical member or the second mechanical member.

Further, sliding connection or linkage may be used for the connection among the first mechanical member, the second mechanical member and the speed-controllable power drive.

Further, except the arrangement on the first or second mechanical member, the first sensor set of the induction control unit can be installed in the speed-controllable power drive at a selected location, and the second sensor set can be installed in first or second mechanical member. In other words, the second sensor set of the induction control unit comprises a first switch and a second switch, and the first sensor set of the induction control unit is a switch controller.

Further, the exerciser is not limited to any specific type of physical training machine. It can be designed in any of a variety of forms for training the legs, the hands, or any other parts of the body. For example, the exerciser can be a leg-lifting machine, waist-twisting machine, weight-lifting machine, or rowing machine.

In conclusion, the invention provides an exerciser that provides speed-controllable power subject to operation. The exerciser uses an induction control unit to match with a speed-controllable power drive to provide a force corresponding to or against the operation direction of the user for concentric training (where the applied force is against the direction of the muscle contraction) or eccentric training (where the applied force and the muscle contraction are in the same direction).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An exerciser, comprising:

a mechanical unit, said mechanical unit comprising a first mechanical member, and a second mechanical member operable by one part of the body of a human being;

a speed-controllable power drive, said speed-controllable power drive comprising a first connection end and a second connection end respectively connected to said first mechanical member and said second mechanical member of said mechanical unit, said speed-controllable power drive being drivable by a power source to move said second mechanical member in making a first action and a second action relative to said first mechanical member; and an induction control unit, said induction control unit comprising a first sensor set installed in said mechanical unit and a second sensor set installed in said speed-controllable power drive for controlling the operation of said speed-controllable power drive, said first sensor set being movable with said mechanical unit relative to said second sensor set between a first position where said induction control unit drives said speed-controllable power drive to move said second mechanical member in making said first action and a second position where said induction control unit drives said speed-controllable power drive to move said second mechanical member in making said second action.

2. The exerciser as claimed in claim 1, wherein said first sensor set of said induction control unit comprises a first switch and a second switch; said second sensor set of said induction control unit is a switch controller.

3. The exerciser as claimed in claim 1, wherein said second sensor set of said induction control unit comprises a first switch and a second switch; said first sensor set of said induction control unit is a switch controller.

4. The exerciser as claimed in claim 1, wherein said speed-controllable power drive comprises a motor and screw set, hydraulic cylinder, pneumatic cylinder or worm and worm gear set.

5. The exerciser as claimed in claim 1, wherein the operation speed of said speed-controllable power drive is a constant speed, acceleration or deceleration.

6. The exerciser as claimed in claim 1, wherein the action of said speed-controllable power drive is operable to make a linear action, swinging action or rotary action.

7. The exerciser as claimed in claim 1, wherein said speed-controllable power drive comprises a body and an actuating member movable relative to said body.

8. The exerciser as claimed in claim 1, wherein said first mechanical member and said second mechanical member are movable relative to each other in parallel displacement, swinging, rotation, or their combination.

9. The exerciser as claimed in claim 1, wherein said mechanical unit is connected to the first connection end or second connection end of said speed-controllable power drive in such a manner that said mechanical unit and said speed-controllable power drive are movable relative to each other in a linear or rotary motion.

10. The exerciser as claimed in claim 1, wherein said first mechanical member has a connection portion; said second mechanical member has a connection portion connected to the connection portion of said first mechanical member in such a manner that said first mechanical member and said second mechanical member are movable relative to each other in a linear or rotary motion.

* * * * *